US005678769A

United States Patent [19]

Jacobs

[11] Patent Number: 5,678,769

[45] Date of Patent: Oct. 21, 1997

[54] THERMOSTATIC AIR CONTROL FOR AN AIR ASSIST FUEL INJECTOR

[75] Inventor: Michael A. Jacobs, Yorktown, Va.

[73] Assignee: Siemens Automotive Corporation, Auburn Hills, Mich.

[21] Appl. No.: 575,048

[22] Filed: Dec. 19, 1995

Related U.S. Application Data

[63] Continuation-in-part of Ser. No. 455,504, May 31, 1995, abandoned.

[51] Int. Cl.[6] ..... B05B 1/30

[52] U.S. Cl. ..... 239/585.1; 239/397.5; 239/576

[58] Field of Search ..... 239/584, 585.1, 239/585.2, 586, 576, 397.5, 409, 413, 75; 137/78.1, 457; 251/191, 340; 123/339.16, 339.24, 470, 478, 585

[56] References Cited

U.S. PATENT DOCUMENTS

| | | | |
|---|---|---|---|
| 3,964,457 | 6/1976 | Coscia | 123/119 F |
| 4,303,048 | 12/1981 | Nishio | 123/339 |
| 4,991,547 | 2/1991 | Davis | 123/52 MF |
| 5,148,788 | 9/1992 | Saikalis | 123/39 |
| 5,409,169 | 4/1995 | Saikalis | 239/404 |
| 5,551,400 | 9/1996 | Rice | 123/470 |

*Primary Examiner*—Robert J. Oberleitner
*Assistant Examiner*—C. T. Bartz
*Attorney, Agent, or Firm*—Russel C. Wells

[57] ABSTRACT

A thermostatic air control for assist air to a fuel injector utilizes a bi-metallic ring to seal the air inlets when the engine temperature has increased. This in effect prevents the flow of assist air when the engine is warm and the need for assist air is not required. The bi-metallic ring can have either a positive or negative temperature coefficient and is positioned either on the inside or the outside, respectively of the air assist shroud of either a top or bottom feed fuel injector. A small orifice having a predetermined size and discharge coefficient provides a constant air flow to the output of the injector.

4 Claims, 2 Drawing Sheets

THERMOSTATIC AIR CONTROL FOR AN AIR ASSIST FUEL INJECTOR

CROSS REFERENCE TO RELATED APPLICATION

This application is a continuation-in-part of application Ser. No. 08/455,504, now abandoned filed on May 31, 1995 entitled "Thermostatic Air Control For An Air Assist Fuel Injector" by Michael A. Jacobs.

FIELD OF INVENTION

This invention relates to electromagnetic fuel injectors in general and more particularly to control of the assist air supplied to air-assist fuel injectors.

BACKGROUND OF INVENTION

The air-assist fuel injector was developed to provide emissions improvement on internal combustion gasoline fueled engines as commonly used in motor vehicles, Such emission improvements derived from an air-assist fuel injector occur at low engine operating temperatures. When the engine temperature has increased sufficiently from a cold engine, it is desirable to shutoff the air-assist function.

For present engine systems utilizing air-assist fuel injectors, air is channeled from a control valve which is controlled by the engine management system. The control valve channels the air through the engine to the injectors. The air may be supplied to the injectors by various means such as a manifold air passageway connected to an air inlet on the injector; an adapter on the injector for receiving an air conduit; etc.

The control valve is positioned in such a way as to be the common supply for all of the fuel injectors on the engine. When the control valve is closed, and due to the various interconnections, there is a potential for air to flow between the various injectors on the engine. Since this airflow is caused by pressure fluctuations of the engine operating cycle, it is generally detrimental to the engine performance.

Further with the current air-assist system designs, any loss of sealing integrity anywhere in the system between the air-assist control valve and the air-assist fuel injectors can result in the loss of the engine idle speed control.

Some engine designers want to keep a small amount of air flowing into the air assist injector mainly for the reason of purging the assist air passageways to avoid plugging. In order to accomplish this, a proportional solenoid valve controls the air passageways and when the temperature of the engine reaches a predetermined value, the valve greatly reduces the air flow along the passageways. Such a result is costly and add much complexity to the engine management system.

SUMMARY OF INVENTION

It is a principle advantage of this invention to eliminate the control valve described above as used in an air-assist fuel injector system.

It is another advantage of this invention to eliminate the potential for air flow between the injectors during the times that the air-assist function is turned off by closing the air supply at each fuel injector.

It is still another advantage of this invention to eliminate the failure of the engine idle speed control by controlling the airflow at the fuel injector.

It is yet another advantage to allow a small amount of assist air to continue to flow into the fuel being ejected from the injector after the engine reaches operating temperature.

These and other advantages are present in the thermostatic air control for an air assist electromagnetic fuel injector for an internal combustion engine described and claimed herein. The internal combustion engine has a manifold and at least one intake valve means for admitting an air fuel charge into the engine. The fuel injector has a valve body member housing a valve member, valve seat and a fuel metering orifice at the end of the injector wherein fuel is ejected from the injector into the manifold.

A receiving means having an air inlet means is connected to the injector for receiving assist air. The receiving means operates to direct the received assist air to an air orifice position downstream of the fuel metering orifice for mixing the ejected fuel with the assist air. An air supply means supplies assist air to the receiving means. A means, such as a bi-metallic means, is connected to the receiving means and operates in response to the ambient temperature of the injector for controlling the flow of assist air into the injector by opening and closing the air inlet means.

In one embodiment, the receiving means is a shroud member positioned around the valve body and is sealed in the manifold. The bi-metallic ring means is a positive temperature coefficient non continuous circular member located between the valve body member and the shroud. When the environmental temperature of the injector reaches a predetermined temperature indicating that assist-air is not required, the bi-metallic means closes the air inlet in the shroud. This operates to remove the assist air from the fuel ejected by the injector into the engine.

In another embodiment, the bi-metallic means means is a negative temperature coefficient non continuous circular member located around the outside of the shroud. When the environmental temperature of the injector reaches a predetermined temperature indicating that assist-air is not required, the bi-metallic means closes the air inlet in the shroud. This operates to remove the assist air from the fuel ejected by the injector into the engine.

In still another embodiment, the bi-metallic means, either an interior or an exterior member, has a small orifice positioned opposite the air inlet in the shroud to allow a small amount of air to flow into the injector.

In yet still another embodiment, the bi-metallic means is solid and a small orifice is positioned in the shroud to allow air to flow from the cavity around the injector into the interior of the shroud. Air through the small orifice is in parallel to the flow of the air through the air inlet to the shroud.

These and other advantages will be made apparent from the following detailed description and drawings.

DETAILED DESCRIPTION OF A PREFERRED EMBODIMENT

Figure 1:
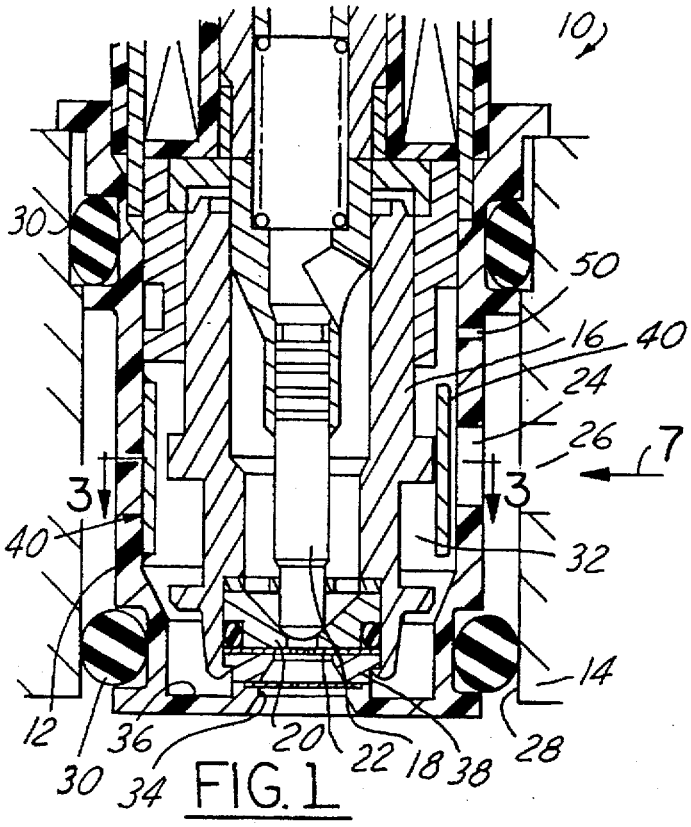
FIG. 1 is a partial cross-sectional view of an air assisted fuel injector having a bi-metal means between the shroud and the valve body.

Referring to FIG. 1 there is illustrated in a longitudinal cross section, a fuel injector 10 with an air assist shroud or receiving means 12 such as that found in U.S. Pat. No. 5,174,505 issued to J. Shen and assigned to a common assignee. The injector 10 and receiving means or shroud 12 are mounted in a manifold 14 of an internal combustion engine. One or more intake valve means, not shown, are located downstream from the injector 10 and the shroud 12 for admitting an air fuel charge into the engine.

The injector 10 has a valve body member 16 housing a valve member 18, a valve seat 20, and a fuel metering orifice 22 for metering fuel from the injector 10. At the end of the valve body member 16, the injector ejects fuel into the air stream in the manifold 14 to be ingested into the engine. The injector 10 illustrated is a top feed electromagnetic fuel injector wherein fuel is supplied to the injector at one end, not shown, and ejected from the end of the valve body member 16 at the opposite end of the injector. Bottom feed injectors may also be used. In each case, the fuel is being ejected from one end of the injector 10, and it matters not how the fuel is supplied to the injector.

Figure 2:
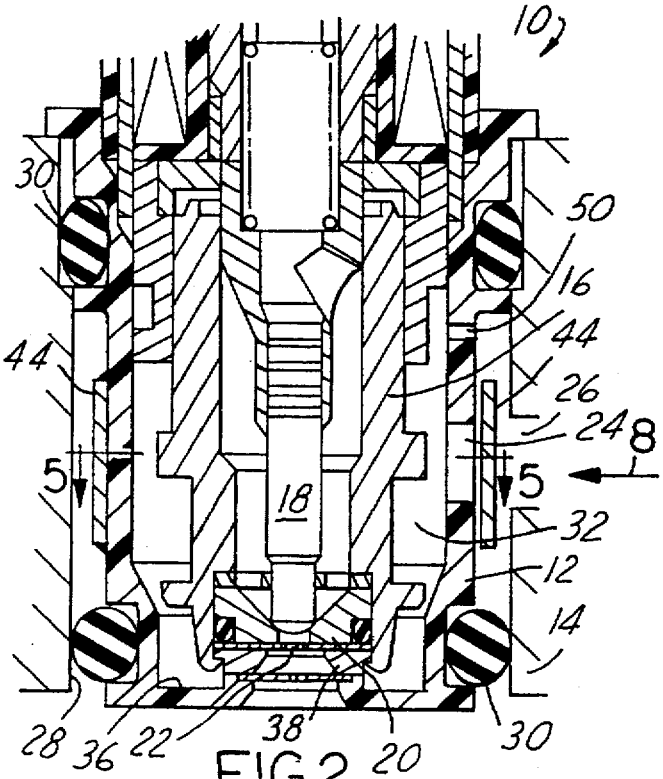
FIG. 2 is a partial cross-sectional view of an air assisted fuel injector having a bi-metal means around the outside of the shroud.

Connected to the valve body member 16 of the injector is a receiving means or a shroud 12 which is used to provide assist air at the output of the injector. In many instances the shroud 12 is a molded member from either plastic or metal. The shroud 12 has an air inlet 24 for receiving assist air from an air supply means which is illustrated as an air passageway 26 in the manifold. The shroud 12 is located in a bore 28 in the manifold 14 and is sealed therein by a plurality of O-rings 30. In FIGS. 1 and 2 the O-rings 30 are positioned on either side of the assist air passageway 26.

The shroud 12 and the valve body member 16 cooperate to form an air passageway 32 from the air inlet 24 to an air orifice 34 along the bottom surface 36 of the shroud. Another air passageway 38 located in the bottom of the shroud 12 is connected to the air passageway to conduct the assist air to the stream of fuel being ejected from the valve body member 16.

Figure 3:
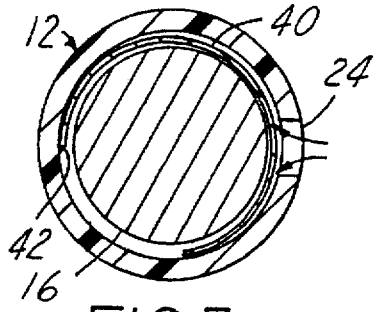
FIG. 3 is a view taken along line 3—3 of FIG. 1.

In FIG. 1, located on the inside of the shroud 12 and attached thereto is a bi-metallic ring 40 positioned to cover the air inlet 24 of the shroud 12. The bi-metallic ring 40 is a non-continuous circular member which is secured at one end 42 to the inside of the shroud. When the ambient temperature around the injector is low, the bi-metallic ring 40 is relaxed and is in the position illustrated in FIG. 3 such that the assist air entering the shroud 12 through the air inlet 24 means is unobstructed. As the ambient temperature increases, the bi-metallic ring 40, having a positive temperature coefficient, expands and begins to close off the air inlets 24 of the shroud 12. Once the air inlets 24 are closed off, the assist air can no longer mix with the fuel being ejected. Since the air is closed off at the injector, the potential for air flow between the injectors is eliminated.

Figure 4:
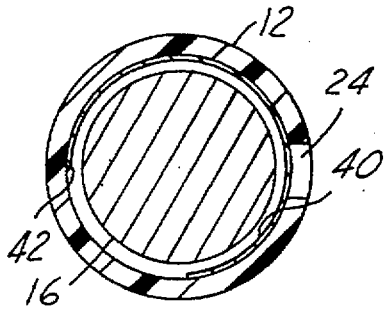
FIG. 4 is a view illustrating the operation of the ring of FIG. 3.

FIG. 4 illustrates the bi-metallic ring 40 being expanded to close air inlets 24. When the engine is turned off and the ambient temperature around the valve body 16 is reduced, the bi-metallic ring 40 relaxes and the air inlets 24 are opened for the next cold start of the engine. However, if the engine is warm, the bi-metallic ring 40 remains expanded and the assist air is shut off from entering the shroud.

Figure 5:
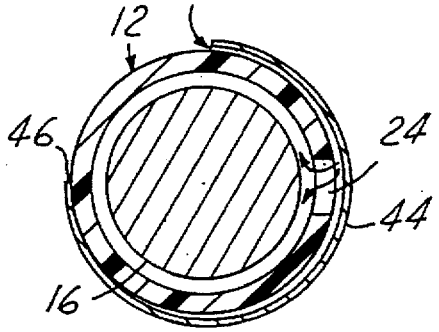
FIG. 5 is a view taken along line 5—5 of FIG. 2.
Figure 6:
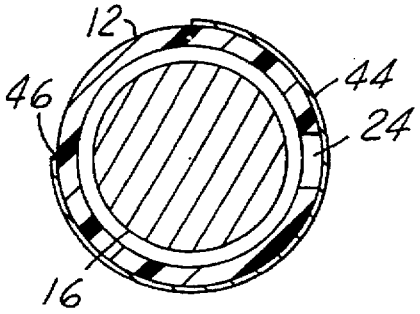
FIG. 6 is a view illustrating the operation of the ring of FIG. 5.

FIG. 2 is an illustration of another embodiment wherein the bi-metallic ring 44 is secured 46 at one end to the outside of the shroud 12 and when the ambient temperature is increased, the ring 44 closes down on the shroud 12 to seal the air inlet means 24. In this embodiment, the bi-metallic ring 44 has a negative temperature coefficient. FIGS. 5 and 6 illustrate the bi-metallic ring 44 in both its relaxed state in FIG. 5 and when the ring 44 has contracted to close off the air inlets in FIG. 6.

In some applications it is desirable, even after the ambient temperature has increased sufficiently, to reduce the airflow to a predetermined lower level. This reduced flow level functions to keep the air-assist function purged of fuel vapor and other contaminants. This would be easy to do by the addition of a proportional control valve with all of its attendant costs and complexity. The orifices 48 and 50 located in the bi-metallic rings 40 and 44 and in the shroud 12, accomplish this reduced flow level without the need for additional control valves.

In FIGS. 1 and 2, a small orifice 50 provides a parallel air flow from the air passageway 26 in the manifold to the air passageway 32 in the shroud. One path is through the air inlet 24 and the second parallel path is through the orifice 50. Thus, at all times air flows between the passageways 26 and 32. As an example, the diameter of the orifice 50 is typically 1 mm (0.039") in diameter and the discharge coefficient is between 0 and 1.00 with a typical coefficient of 0.800.

Figure 7:
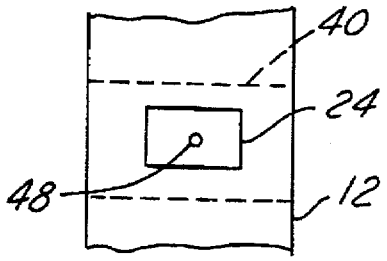
FIG. 7 is a side view of the bi-metallic means on the inside of the shroud with a small orifice adjacent the air inlet of the shroud.

FIG. 7 illustrates a view of the injector of FIG. 1 from the side and through the air inlet 24. Shown in dotted lines is the positive temperature coefficient bi-metallic ring means 40. In line with the air inlet is a small orifice 48 in the ring means which functions when the temperature of the air entering the shroud 12 causes the ring means 40 to close off the air inlet 24. The dimensions of the orifice are such that air flowing through the orifice is very much controlled. As an example of such an orifice 48, a typical set of dimensions are 1 mm (0.039") in diameter and a coefficient of discharge of the orifice is between 0 and 1.00 and more particularly a coefficient of 0.800.

Figure 8:
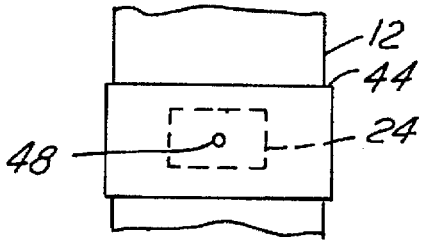
FIG. 8 is a side view of the bi-metallic means on the outside of the shroud with a small orifice adjacent the air inlet of the shroud.

FIG. 8 illustrates a view of the injector 10 of FIG. 2 from the side and the negative coefficient bi-metal ring means 44 is around the outside of the shroud 12 covering the air inlet 24. In line with the air inlet is a small orifice 48 in the ring means 44 which functions when the temperature of the air entering the shroud causes the ring means to close off the air inlet. The dimensions of the orifice are such that air flowing through the orifice is very much controlled. As an example of such an orifice a typical set of dimensions are 1 mm in diameter; a coefficient of discharge of the orifice is between 0 and 1.00 and more particularly a coefficient of 0.800.

Figure 9:
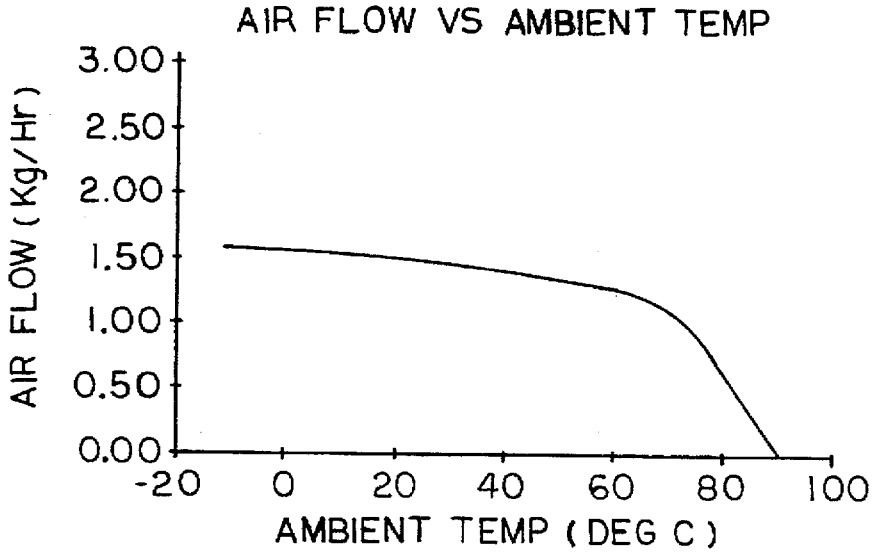
FIG. 9 is a graph of the air flow at temperature with the bi-metallic means going from a fully open air inlet to a fully closed air inlet.

FIG. 9 is a graph showing the operation of the injector of either FIG. 1 or FIG. 2, without either small orifice 48 in the bi-metallic means 40 or 44 or the small orifice 50 in the shroud 12 during the time the ambient temperature of the air is increasing. When the temperature coefficient of the ring means causes the ring to expand and block the air inlet 24, the flow of the air goes to zero. In this particular graph, the temperature is greater than 80° C., the air inlet is closed.

Figure 10:
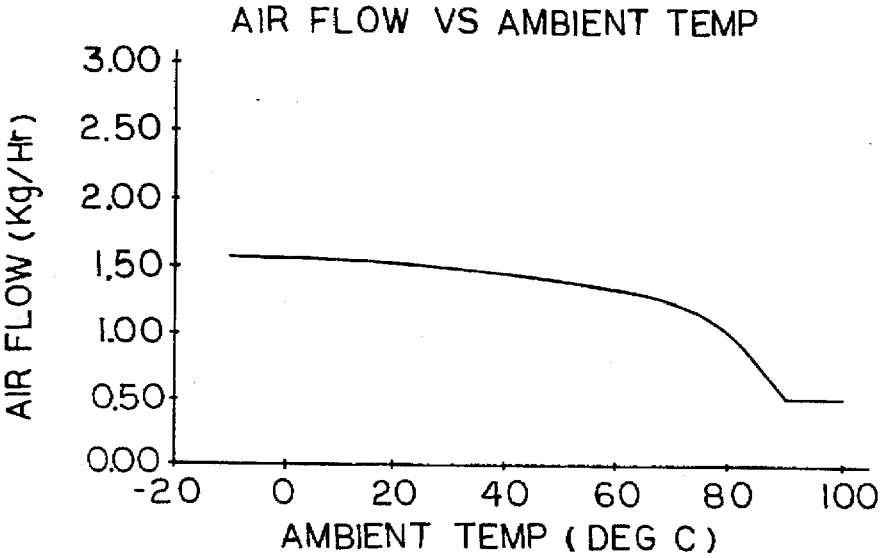
FIG. 10 is a graph of the air flow at temperature with a small orifice in parallel flow relations to the bi-metallic means going from a fully open air inlet to a fully closed air inlet.

FIG. 10 is a graph showing the operation of the injector of either FIG. 1 or FIG. 2 with either small orifice 48 in the bi-metallic means 40 or 44 or the small orifice 50 in the shroud 12 during the time the ambient temperature of the air is increasing. When the temperature coefficient of the ring means causes the ring to expand and block the air inlet 24, the flow of the air goes through the parallel small orifice 48 in the ring 40 or 44 or the small orifice 50 in the shroud 12 and some small but defined amount of air flow remains. As illustrated, this is less than 0.50 Kg/Hr of air flow at 100° C.

Thus, depending upon the size of the small orifices 48 and 50, the air flow rate at high ambient temperature can be adjusted.

There has thus been illustrated and described an thermostatic air control for an air assist electromagnetic fuel injector which eliminates the need for a control valve to control the flow of assist air to the injectors. With the bi-metallic ring, the potential for air flow between the injectors of the engine is eliminated. In addition, the idle speed control of the engine is not affected since the air control is located at the injector and not in the air stream to the injector. In an alternate embodiment, a small flow parallel to the main air assist flow is present at high ambient temperatures.

What is claimed is:

1. A thermostatic air control for an air assist electromagnetic fuel injector for an internal combustion engine having a manifold, at least one intake valve means for admitting an air fuel charge into the engine, said control comprising;

a valve body member on the injector housing a valve member, valve seat and a fuel metering orifice at the end of the injector wherein fuel is ejected from the injector into the manifold;

a shroud member positioned around said valve body and sealed in the manifold means and having an air inlet for receiving assist air, said shroud member for directing said assist air to an air orifice position downstream of said fuel metering orifice for mixing the ejected fuel with said assist air;

air supply means for supplying assist air to said receiving means; and a positive temperature coefficient, non continuous circular bi-metallic ring member located between said valve body member and said shroud for closing the air inlet means in response to the ambient temperature of said injector for removing the assist air from the fuel ejected by the injector into the engine.

2. A thermostatic air control for an air assist electromagnetic fuel injector according to claim 1 additionally including an orifice means located in said bi-metallic ring and opposite said air inlet for continuing to provide air flow to said air orifice when said ring has closed said air inlet.

3. A thermostatic air control for an air assist electromagnetic fuel injector for an internal combustion engine having a manifold, at least one intake valve means for admitting an air fuel charge into the engine, said control comprising:

a valve body member on the injector housing a valve member, valve seat and a fuel metering orifice at the end of the injector wherein fuel is ejected from the injector into the manifold;

a shroud member positioned around said valve body and sealed in the manifold means and having an air inlet for receiving assist air, said shroud member for directing said assist air to an air orifice position downstream of said fuel metering orifice for mixing the ejected fuel with said assist air;

air supply means for supplying assist air to said receiving means; and a negative temperature coefficient, non continuous circular bi-metallic ring member located between said valve body member and said shroud for closing the air inlet means in response to the ambient temperature of said injector for removing the assist air from the fuel ejected by the injector into the engine.

4. A thermostatic air control for an air assist electromagnetic fuel injector according to claim 3 additionally including an orifice means located in said bi-metallic ring and opposite said air inlet for continuing to provide air flow to said air orifice when said ring has closed said air inlet.

* * * * *